US009534361B2

(12) United States Patent
Grether

(10) Patent No.: US 9,534,361 B2
(45) Date of Patent: Jan. 3, 2017

(54) JET REGULATOR

(71) Applicant: Neoperl GmbH, Mullheim (DE)

(72) Inventor: Hermann Grether, Mullheim (DE)

(73) Assignee: NEOPERL GMBH, Mullheim (DE)

( * ) Notice: Subject to any disclaimer, the term of this patent is extended or adjusted under 35 U.S.C. 154(b) by 28 days.

(21) Appl. No.: 14/671,241

(22) Filed: Mar. 27, 2015

(65) Prior Publication Data

US 2015/0204058 A1 Jul. 23, 2015

Related U.S. Application Data

(63) Continuation-in-part of application No. 13/636,821, filed as application No. PCT/EP2010/007452 on Dec. 8, 2010, now Pat. No. 9,016,602.

(30) Foreign Application Priority Data

Mar. 23, 2010 (DE) ..... 10 2010 012 326

(51) Int. Cl.
*E03C 1/08* (2006.01)
*E03C 1/084* (2006.01)

(52) U.S. Cl.
CPC ..... *E03C 1/084* (2013.01)

(58) Field of Classification Search
CPC ..... E03C 1/08; E03C 1/084; E03C 2201/70
USPC ..... 239/428.5, 432, 461, 463, 466, 467, 494,239/495, 496, 500, 504; 137/801
See application file for complete search history.

(56) References Cited

U.S. PATENT DOCUMENTS 2,633,343 A * 3/1953 Aghnides ..... E03C 1/084 210/449
2,754,097 A * 7/1956 Hjulian ..... E03C 1/084 210/198.1
2,797,906 A * 7/1957 Aghnides ..... E03C 1/084 137/872
2,998,929 A * 9/1961 Aghnides ..... B01F 3/0473 239/428.5
2,998,933 A * 9/1961 Aghnides ..... B01F 3/0473 239/428.5

(Continued)

FOREIGN PATENT DOCUMENTS

DE 4436193 A1 4/1996
DE 19852411 A1 5/2000

(Continued)

*Primary Examiner* — Justin Jonaitis
(74) *Attorney, Agent, or Firm* — Volpe and Koenig, P.C.

(57) ABSTRACT

A jet regulator includes a ring-shaped or sleeve-shaped jet regulator housing, the outlet face side of which is formed as a perforated, grate and/or mesh structure with throughflow openings bordered by flow-guiding walls. The perforated, grate and/or mesh structure on the outlet face side is produced at least in regions and at least on the surface from a manually deformable dimensionally elastic plastic material. The outlet face side of the jet regulator housing is in the form of an outlet disk which can be inserted into the jet regulator housing and which bears the perforated, grate and/or mesh structure. The separate configuration of the outlet disk on the one hand and the jet regulator housing on the other hand facilitates the separate production of said jet regulator constituents even from materials which cannot be welded or otherwise connected to one another, if appropriate in different production processes.

21 Claims, 7 Drawing Sheets

(56) References Cited

U.S. PATENT DOCUMENTS

Figure 2:
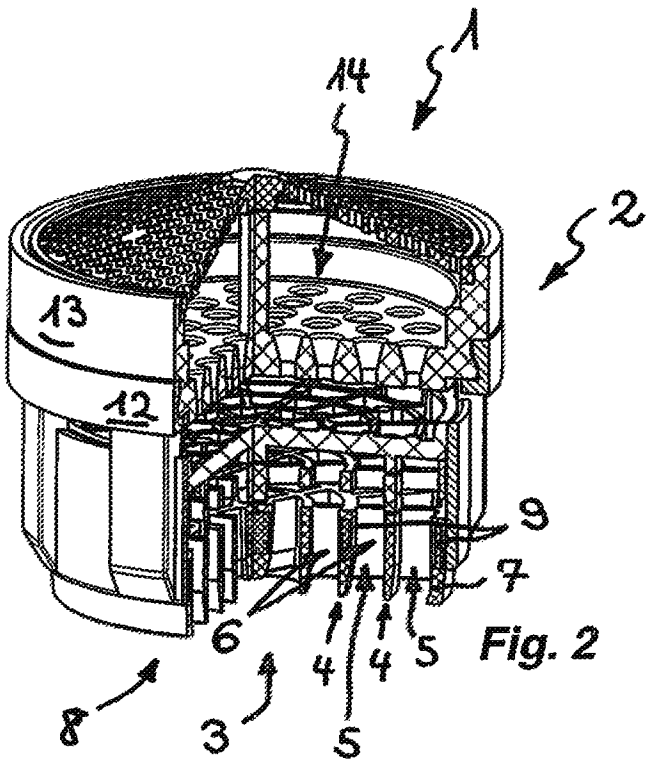

| | | | | | |
|---|---|---|---|---|---|
| 3,138,332 | A * | 6/1964 | Hinderer | E03C 1/084 | 239/427 |
| 3,684,191 | A * | 8/1972 | Shames | E03C 1/084 | 239/428.5 |
| 5,114,072 | A * | 5/1992 | Barhydt, Sr. | E03C 1/08 | 239/428.5 |
| 2005/0247805 | A1 * | 11/2005 | Grether | B05B 1/18 | 239/428.5 |
| 2006/0011748 | A1 * | 1/2006 | Ferrari | E03C 1/084 | 239/428.5 |

FOREIGN PATENT DOCUMENTS

| | | | |
|---|---|---|---|
| DE | 202005021363 | U1 | 10/2007 |
| EP | 0597344 | A1 | 5/1994 |
| EP | 1918465 | A2 | 5/2008 |
| WO | 9506787 | A1 | 3/1995 |
| WO | 2004033807 | A1 | 4/2004 |

* cited by examiner 12
11
107
7
8
9

102
100
8
3
7
9

12
108
36
12
105
107

105
108
36
23
101
102
100
8
13
12

JET REGULATOR

INCORPORATION BY REFERENCE

The present application is a Continuation-in-Part of U.S. patent application Ser. No. 13/636,821, filed Sep. 24, 2012, the entire contents of which are incorporated by reference herein as if fully set forth.

FIELD OF THE INVENTION

The invention relates to a jet regulator having a ring-shaped or sleeve-shaped jet regulator housing which can be mounted on the water outlet of a sanitary outlet fitting, the outlet face side of which jet regulator housing is formed as a perforated, grate and/or mesh structure with throughflow openings bordered by flow-guiding walls, wherein the perforated, grate and/or mesh structure on the outlet face side is produced at least in regions and at least on the surface from a manually deformable dimensionally elastic plastic material.

BACKGROUND

Already known from DE 198 52 411 A1 is a jet regulator which can be mounted on a sanitary outlet fitting. The already-known jet regulator has a jet regulator housing which is in the form of a sleeve-shaped molded body on which a soft or dimensionally elastic plastic material is injection-molded at the outlet side. That constituent of the jet regulator housing which is composed of soft or dimensionally elastic plastic material forms a soft and/or water-repellent surface, the aim of which is to substantially prevent limescale formation. It is the intention for adherent limescale deposits to be easily detachable by slight manual deformation of the soft or dimensionally elastic plastic material which is injection-molded on the surface. Since it must be ensured with regard to the material selection that the soft or dimensionally elastic plastic material can be injection-molded onto the relatively hard or dimensionally rigid plastic material of the jet regulator housing, the production of the already-known jet regulator can require a not inconsiderable amount of additional outlay.

It is therefore the object to create a jet regulator of the type mentioned in the introduction which can be produced from a wide variety of materials with relatively little outlay.

SUMMARY

Said object is achieved according to the invention, in the case of the jet regulator of the type mentioned in the introduction, in particular in that the outlet face side of the jet regulator housing is in the form of an outlet disk which can be inserted into the jet regulator housing and which bears the perforated, grate and/or mesh structure, and in that the outlet disk is secured in the jet regulator housing in the direction opposite to the throughflow direction by at least one retaining device, which at least one retaining device is held on a constituent, arranged upstream of the outlet disk as viewed in the throughflow direction, of the jet regulator.

In the jet regulator according to the invention, the outlet face side of the jet regulator housing is thus formed as an outlet disk which can be inserted into the jet regulator housing and which bears the perforated, grate and/or mesh structure. The separate configuration of the outlet disk on the one hand and the jet regulator housing on the other hand facilitates the separate production of said jet regulator constituents even from materials which cannot be welded or otherwise connected to one another, if appropriate also in different production processes. The materials required for the outlet disk on the one hand and for the jet regulator housing on the other hand can be freely selected independently of one another in accordance with the relevant permissions, demands and the like. For the production of the jet regulator housing, therefore, it is possible for example to use an ultrasound-weldable material, which by contrast may not be preferable for the outlet disk. It is provided according to the invention that the outlet disk is secured in the jet regulator housing in the direction opposite to the throughflow direction by at least one retaining device. Said at least one retaining device is held on a constituent, arranged upstream of the outlet disk as viewed in the throughflow direction, of the jet regulator. Since the outlet face side of the jet regulator according to the invention is configured as an outlet disk which merely has to be inserted into the jet regulator housing, and since the outlet disk is secured in said jet regulator housing by the at least one retaining device, the production of the jet regulator according to the invention is made much simpler, and at the same time, said jet regulator is characterized by high stability of the constituents that are inserted one into the other.

Here, one preferred embodiment of the invention provides that the outlet disk is formed as a multi-component injection-molded part which has a main or molded body composed of hard or dimensionally rigid plastic material and onto which is injection-molded a constituent composed of comparatively soft or dimensionally elastic plastic material. Such an outlet disk which is formed as a multi-component injection-molded part is characterized, despite the dimensionally elastic plastic material provided at least on the surface, by high dimensional rigidity, even if said outlet disk is supposed to have complex structures.

One particularly simple and preferred embodiment of the invention provides that the outlet disk can preferably be inserted into the jet regulator housing from the inlet-face-side ring or sleeve opening of the jet regulator housing as far as at least one insertion stop. The outlet disk thus rests on the at least one insertion stop and is thus highly capable of withstanding the water pressure of the inflowing water stream.

If the jet regulator according to the invention is to be designed as an aerated jet regulator, it is advantageous for a jet splitter which divides the inflowing water stream into a number of individual jets to be positioned upstream of the outlet disk as viewed in the flow direction. Since a jet splitter of said type leads to an acceleration of the individual jets generated therein, there arises on the outflow side of said jet splitter a negative pressure by means of which ambient air can be sucked into the jet regulator housing, which ambient air is subsequently mixed there with the throughflowing water to form a sparkling, soft water jet, and split up.

The stability of the jet regulator assembled from the constituents inserted one into the other is also additionally increased if that constituent of the jet regulator which bears the at least one retaining device can be preferably detachably latched, or similarly connected, to the jet regulator housing which accommodates the outlet disk within it.

In this case, the production and the assembly of the jet regulator according to the invention is also made much simpler if the at least one retaining device is integrally connected to the constituent that bears it.

The jet splitter that is provided in the jet regulator according to the invention may be configured as a perforated plate which has a multiplicity of throughflow openings in which the inflowing water is split up into a corresponding number of individual jets. A preferred embodiment of the invention provides, however, that the jet splitter has a pot-shaped diffuser, the pot base of which is in the form of an impingement surface which diverts the inflowing water outward and which has throughflow openings in the circumferential wall of its pot shape. The water flowing into said pot-shaped diffuser of the jet splitter is, at the pot base which serves as an impingement surface, diverted outward so as to emerge from the pot interior of the diffuser there through the throughflow openings provided in the circumferential wall of the pot shape.

In order that the jet splitter which has the diffuser can also advantageously be used in an aerated jet regulator, and in order that ambient air can be drawn into the housing interior of the jet regulator housing by means of the jet splitter, which ambient air is mixed and formed there with the throughflowing water to form a sparkling, soft water jet, it is advantageous if the diffuser, at least in that subregion of its circumferential wall which has the throughflow openings, is engaged around by a diffuser ring, which diffuser ring borders, between itself and the diffuser, an annular gap which narrows in the throughflow direction at least in sections and which is open to the outflow side of the jet regulator. In this annular gap that narrows in the throughflow direction, the throughflowing water is subjected to an increase in speed, whereby a negative pressure is generated on the outflow side of the annular gap. With the aid of the negative pressure generated on the outflow side of the narrowing annular gap, it is possible for ambient air to be drawn into the housing interior of the jet regulator housing, which ambient air is mixed there with the throughflowing water.

A preferred refinement of the invention provides that the at least one retaining device is formed integrally on the jet splitter and in particular on the diffuser ring of a jet splitter which is configured as a diffuser.

In this case, one preferred embodiment, by means of which the outlet disk can be held and secured in an effective manner over its entire circumference, provides that the at least one retaining device is configured as an annular wall which is held on the diffuser ring.

In order that the ambient air can be drawn into the housing interior even through the annular wall which serves as retaining device, it is advantageous if the annular wall which serves as retaining device has, in its annular wall subregion adjoining the annular gap at the outflow side, at least one aeration opening for the induction of ambient air, and preferably multiple aeration openings spaced apart from one another in a circumferential direction.

The outlet disk that is inserted into the jet regulator housing is secured there in a particularly effective manner if the outlet disk is arranged between an insertion stop arranged on the housing inner circumference of the jet regulator housing and the at least one retaining device.

In this case, the outlet disk may be arranged between the insertion stop, at one side, and the at least one retaining device, at the other side, with a degree of axial play. A preferred refinement of the invention however provides that the at least one retaining device acts on the outlet disk at its inflow-side flat disk side. If the outlet disk is acted on at its inflow-side flat disk side by the retaining device, the outlet disk is secured in the housing interior of the jet regulator housing practically without play.

An advantageous embodiment of the invention that can be assembled with little outlay provides that the jet regulator housing is of two-part form and has an inflow-side housing part and an outflow-side housing part that can be detachably latched to said inflow-side housing part.

In this case, a particularly advantageous refinement of the invention consists in that, on the inflow-side housing part, the diffuser ring is formed integrally with the at least one retaining device, and/or in that the outlet disk can be inserted into the outflow-side housing part as far as the insertion stop.

To slow the speed of the individual jets generated in the jet splitter and/or to form the water jet into a homogeneous and non-sputtering water jet in the interior of the jet regulator housing, it is expedient for at least one insert part which can be inserted into the jet regulator housing and which has a perforated, grate and/or mesh structure with throughflow openings bordered by flow-guiding walls to be positioned upstream of the outlet disk, and/or downstream of the jet splitter, as viewed in the flow direction.

In order that the structures provided on the outlet disk, on the at least one insert part and/or on the jet splitter can be adapted to one another, it is advantageous for the outlet disk, the at least one insert part and/or the jet splitter to be held in a rotationally secured manner in the jet regulator housing.

To ensure a rotationally secured relative position of those constituents of the jet regulator according to the invention which are inserted into the jet regulator housing, it is advantageous if, on the inner circumference of the jet regulator housing, there is provided at least one guide groove and/or at least one guide projection which interacts with a complementary guide projection and/or with a complementary guide groove on the outlet disk, on the at least one insert part and/or on the jet splitter.

In order that any dirt particles possibly entrained in the inflowing water stream cannot block the structures provided in the jet regulator housing and impair the function of the jet regulator according to the invention, it is advantageous for an upstream or filter screen to be detachably latched, or similarly detachably held, on the jet regulator housing at the inlet side.

A further embodiment of the invention provides that at least one component of the following components: outlet disk, insert part, jet splitter or upstream screen, is supported by means of at least one retaining device, formed in particular as a central pin, which is held on a component which is arranged at the inflow side and/or at the outflow side.

Figure 1:
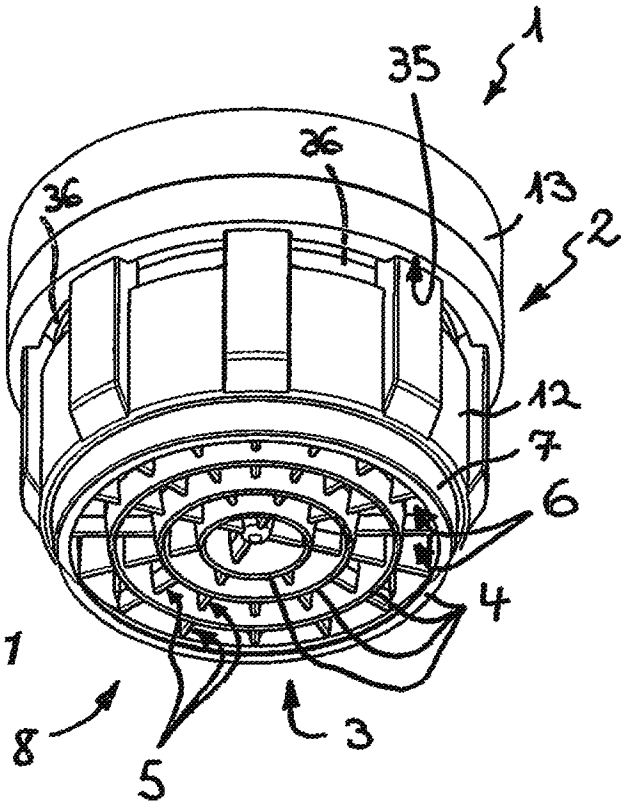
Figures 3, 4, 5, 6:
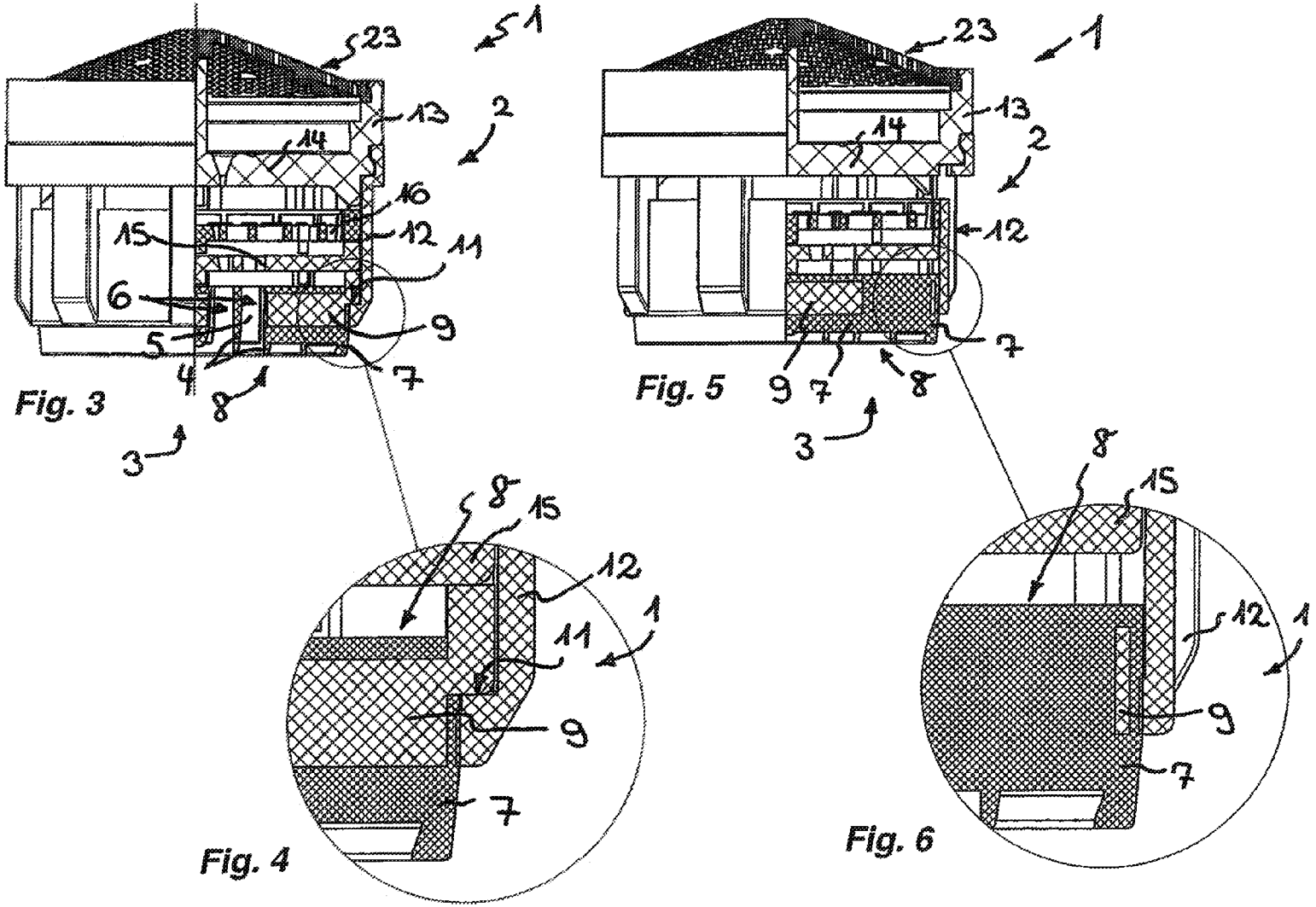
Figure 7:
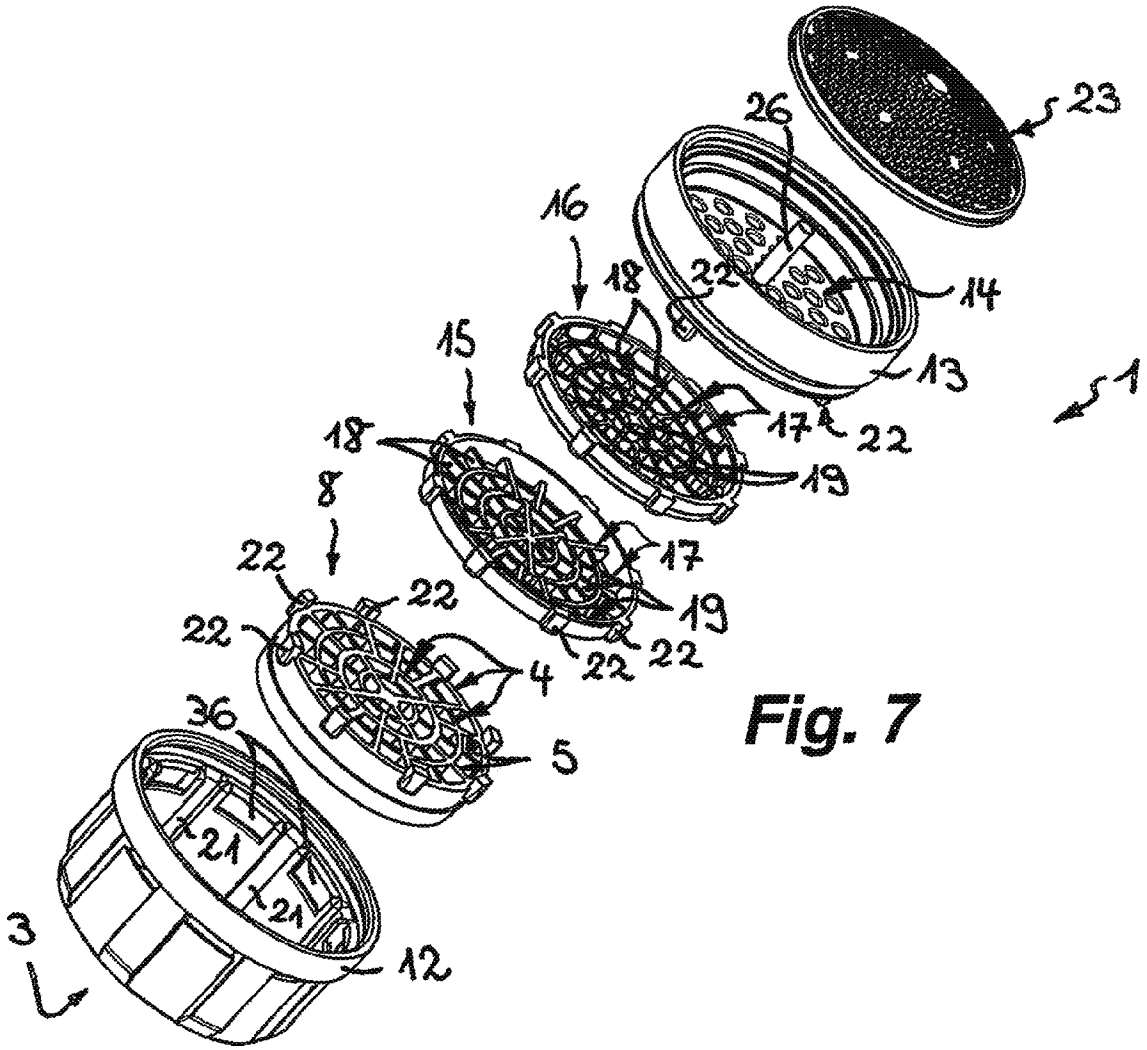
Figure 8:
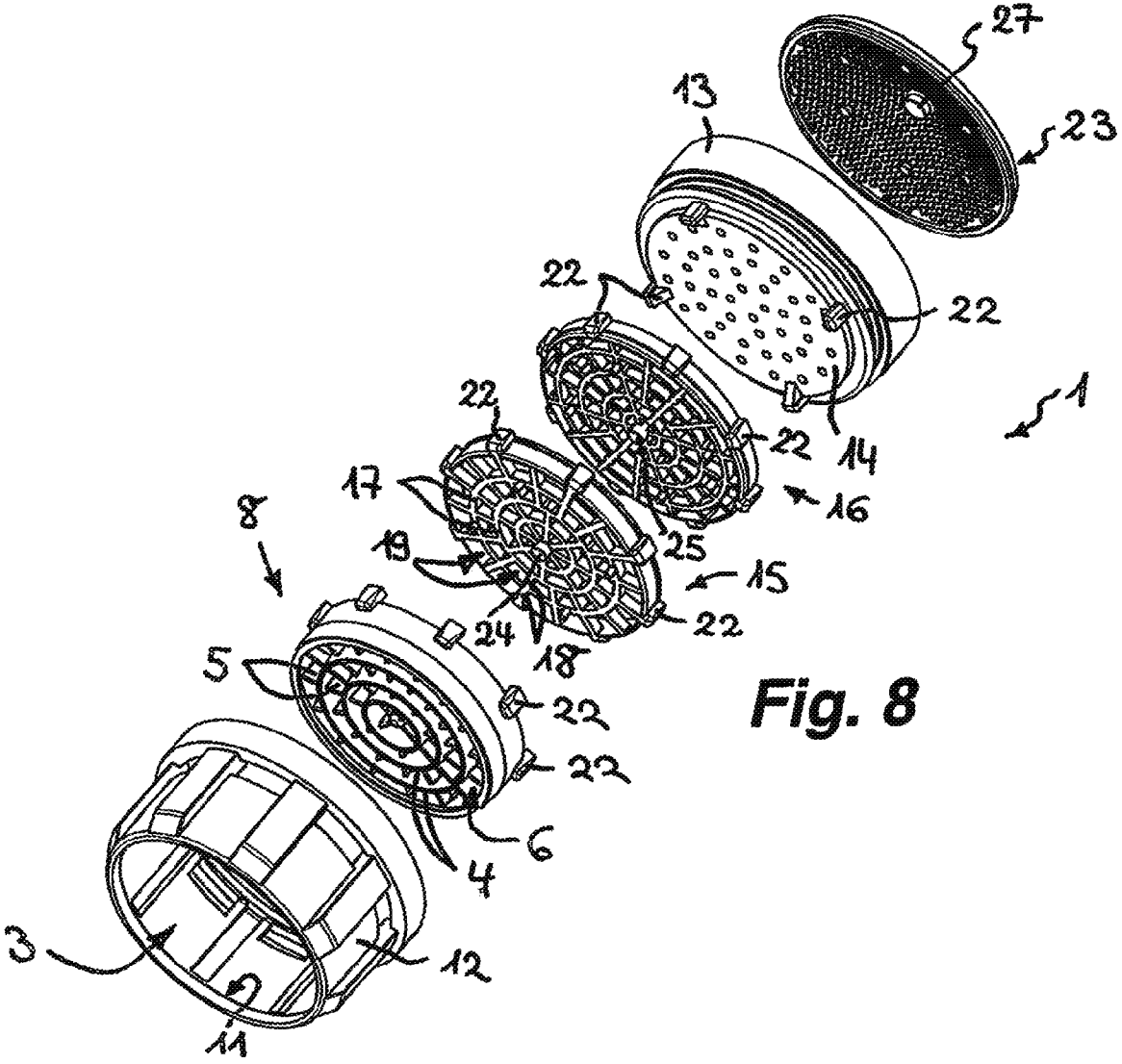
Figure 9:
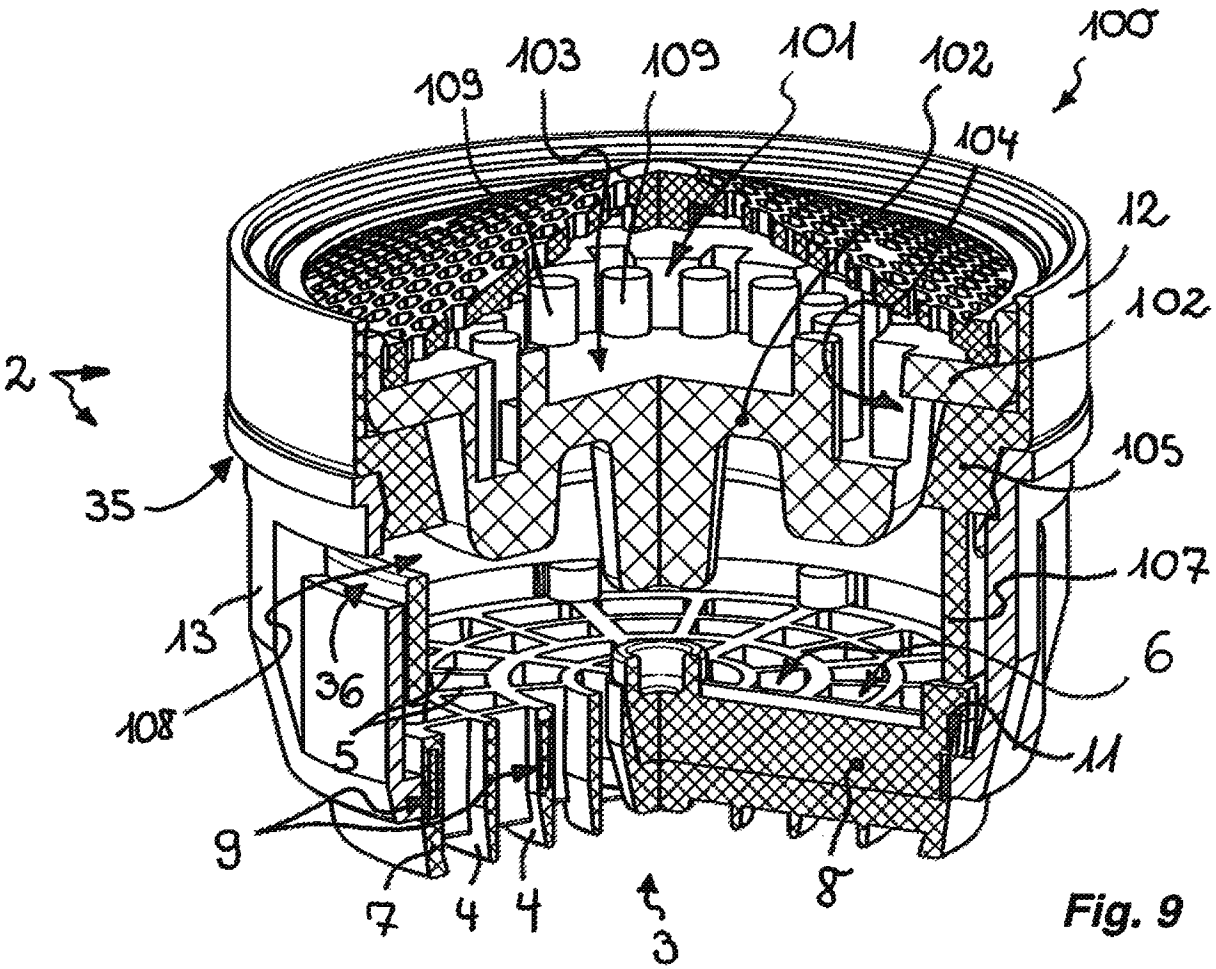
Figures 10, 11, 12, 13:
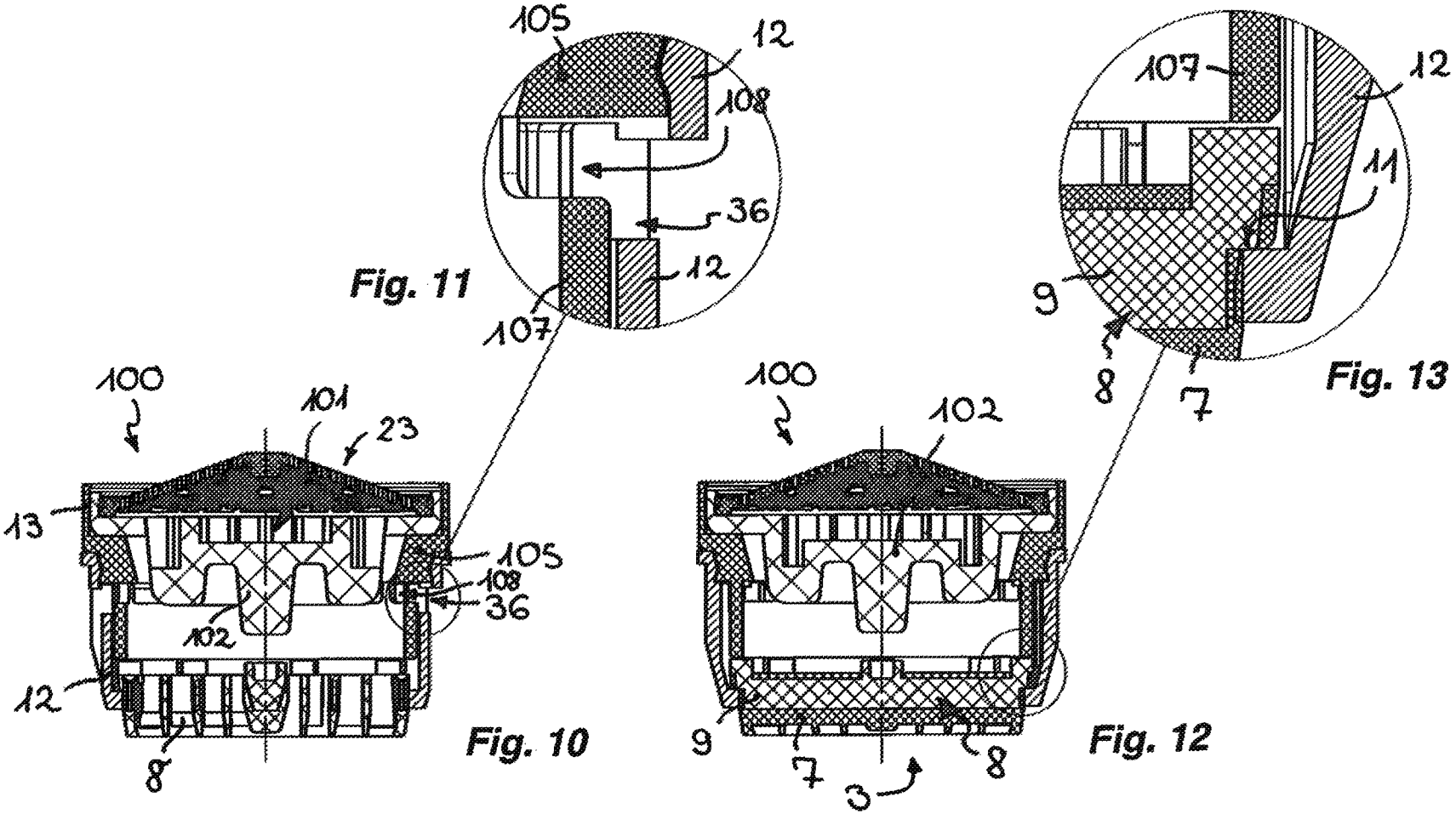
Figure 14:
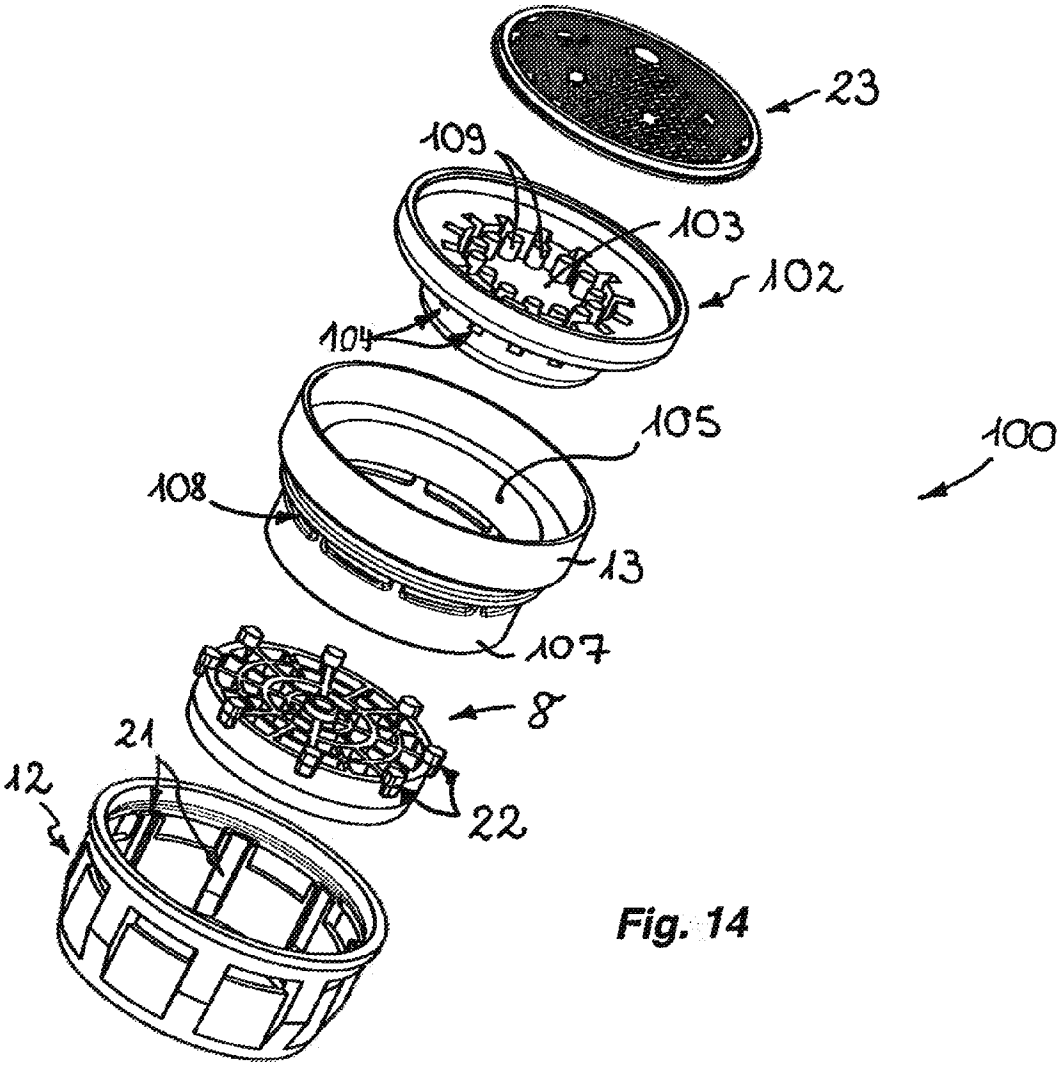

The following detailed description of the preferred embodiment of the present invention will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings:

FIG. 1 shows, in a perspective illustration, a jet regulator which, on the outlet face side of its jet regulator housing, has an outlet disk which can be inserted into the jet regulator housing and which is produced at least in regions and at least on the surface from a manually deformable, dimensionally elastic plastic material, FIG. 2 shows the jet regulator from FIG. 1 in a partially cut-away perspective illustration, FIG. 3 shows the jet regulator from FIGS. 1 and 2 in a partial longitudinal section, FIG. 4 shows the jet regulator from FIGS. 1 to 3 in a detail illustration in the region of its outlet disk inserted into the jet regulator housing, FIG. 5 shows the jet regulator from FIGS. 1 to 4 in a partial longitudinal section rotated in the circumferential direction relative to FIG. 3, FIG. 6 shows the jet regulator from FIGS. 1 to 5 in a longitudinally sectioned detail illustration in the region of the outlet disk inserted into the jet regulator housing, FIG. 7 shows the jet regulator from FIGS. 1 to 6 in an exploded perspective illustration, wherein said illustration shows a view of the inflow side of the individual constituents of the jet regulator, FIG. 8 shows the jet regulator from FIGS. 1 to 7 in an exploded perspective illustration, wherein the illustration shows a view of the outflow side of the constituents of the jet regulator, FIG. 9 shows, in a perspective partial longitudinal sectional illustration, a jet regulator which, in the interior of its jet regulator housing, has a jet splitter in the form of a diffuser, wherein the diffuser borders, between itself and a diffuser ring engaging around the diffuser, an annular gap which narrows in the throughflow direction, and wherein, on the diffuser ring, there is formed a retaining device which is configured as an annular wall and which acts on the inflow-side flat disk side of the outlet disk that forms the outlet face side of the jet regulator, FIG. 10 shows the jet regulator from FIG. 9 in a longitudinal section, FIG. 11 shows the jet regulator from FIGS. 9 and 10 in a longitudinally sectioned detail illustration in the partial region or encircled in FIG. 10, FIG. 12 shows the jet regulator from FIGS. 9 to 11, here shown likewise in a longitudinal section, in a section plane offset in the circumferential direction in relation to FIGS. 10 and 11, FIG. 13 shows the jet regulator from FIGS. 9 to 12 in a longitudinally sectioned detail illustration in that partial region of the outflow-side outlet disk which is encircled in FIG. 12, FIG. 14 shows the jet regulator from FIGS. 9 to 13 in an exploded perspective illustration of the constituents thereof.

DETAILED DESCRIPTION OF THE PREFERRED EMBODIMENTS

FIGS. 1 to 14 show various embodiments 1, 100 of a jet regulator which can be mounted on the water outlet of a sanitary outlet fitting (not shown in any more detail here). The jet regulators 1, 100 have a ring-shaped or sleeve-shaped housing 2, the outlet face side 3 of which is formed as a mesh structure. Said mesh structure is formed by concentric ring-shaped walls 4 which are connected to one another via radial webs 5. The ring-shaped walls 4 and the webs 5 form flow-guiding walls which border circular-arc-shaped throughflow openings 6. The outlet-face-side mesh structure of the jet regulator 1, 100 is produced at least in regions and at least on the surface from a manually deformable, dimensionally elastic plastic material 7, and in particular from silicone, such that the limescale deposits which have adhered to the flow-guiding walls can be easily detached by slight manual deformation of the surface.

As is clear from a comparison of FIGS. 1 to 14, the outlet face side 3 of the jet regulators 1, 100 is in the form of an outlet disk 8 which can be inserted into the jet regulator housing and which bears the mesh structure. The separate configuration of the outlet disk 8 on the one hand and of the jet regulator housing 2 on the other hand facilitates the separate production of said jet regulator constituents from different plastic materials, if appropriate in different production processes. The materials required for the outlet disk 8 on the one hand and for the jet regulator housing 2 on the other hand can be freely selected independently of one another in accordance with the relevant permissions, demands and the like. For the production of the jet regulator housing 2, therefore, it is possible for example to use an ultrasound-weldable material, which by contrast may not be preferable for the outlet disk 8.

In FIGS. 2 to 6, 9, 10, 12 and 13, it can be seen that the outlet disk 8 of the jet regulators 1, 100 is in the form of a multi-component injection-molded part and has a main or molded body 9 which is composed of hard or dimensionally rigid plastic material and onto which is injection-molded the constituent composed of comparatively soft or dimensionally elastic plastic material 7.

In the jet regulators 1, 100 illustrated in FIGS. 1 to 8, the outlet disk 8 can be inserted into the jet regulator housing 2 from the inlet-side sleeve opening of the jet regulator housing 2 as far as an insertion stop 11. Here, the jet regulator housing 2 is of two-part configuration and has an inflow-side and an outflow-side housing part 12, 13. A jet splitter 14 or 101 is positioned upstream of the outlet disk 8 of the jet regulators 1, 100 as viewed in the flow direction.

The jet regulator 1 illustrated in FIG. 1 has a jet splitter which in this case is in the form of a perforated plate and which has the task of dividing the inflowing water stream into a number of individual jets. Whereas the outlet disk 8 is inserted into the inlet-side sleeve opening of the lower outflow-side housing part 12, the jet splitter 14 which is in the form of a perforated disk is integrally formed on the upper, inflow-side housing part 13. At least one insert part 15, 16 can be inserted into the jet regulator housing 2 and in particular into the lower housing part 12 thereof such that said insert parts 15, 16 are positioned upstream of the outlet disk 8, and downstream of the jet splitter 14, as viewed in the flow direction. The insert parts 15, 16 likewise have concentric ring-shaped walls 17 which are connected to one another by radial webs 18, wherein here, too, said ring-shaped walls 17 and said webs 18 form flow-guiding walls which border circular-arc-shaped throughflow openings 19. The insert parts 15, 16 therefore also each have a mesh structure.

The outlet disk 8, the insert parts 15, 16 and the jet splitter 14 are held in a rotationally secured manner in the jet regulator housing 2 of the jet regulator 1 in such a way that their perforated or mesh structures are always arranged in the defined relative position with respect to one another. For this purpose, on the inner circumference of the jet regulator housing 2 and in particular of the lower housing part 12 thereof, there are provided a plurality of guide grooves 21 which interact in each case with a complementary guide projection 22 on the outlet disk 8, on the insert parts 15, 16 and on the jet splitter 14.

An upstream or filter screen 23, which has the task of filtering out any dirt particles entrained in the water, is detachably held on the jet regulator housing 2, and in particular on the upper housing part 13 thereof, at the inlet side. In the longitudinal sections in FIGS. 2, 3 and 5, it can be seen that central pins 24, 25, 26, 27 are integrally formed on the outlet disk 8 and the insert parts 15, 16 and on the upstream screen 23, in such a way that said components 8, 15 and 16 and also 14 and 23 are supported against one another. In this case, the pin 24 formed centrally on the outflow side of the insert part 15 forms a retaining device which secures the outlet disk 8 in the housing interior of the jet regulator housing 2 in the direction opposite to the throughflow direction.

It is clear from FIGS. 1 to 14 that the outlet disk 8, also in its partial region which bears against the jet regulator housing 2, bears the constituent composed of comparatively soft or dimensionally elastic plastic material 7. The soft or dimensionally elastic plastic material 7 which is provided in this region, too, promotes good sealing in the ring-shaped zone between the outlet disk 8 and the housing inner circumference of the jet regulator housing 2.

The jet splitter 101 of the jet regulator 100 shown in FIGS. 9 to 14 has a pot-shaped diffuser 102, the pot base 103 of which is formed as an impingement surface which diverts the inflowing water outward and which has throughflow openings 104 in the circumferential wall of its pot shape. Said diffuser 102 is engaged around, at least in that subregion of its circumferential wall which has the throughflow openings 104, by a diffuser ring 105. Said diffuser ring 105 borders, between itself and the diffuser 102, an annular gap 106 which narrows in the throughflow direction at least in sections. Since the throughflowing water is subjected to an increase in speed in said narrowing annular gap 106, a negative pressure is generated on the outflow side of said annular gap 106, in accordance with the Bernoulli equation. With the aid of said negative pressure on the outflow side of the narrowing annular gap 106, ambient air can be drawn into the housing interior of the jet regulator housing 2, which ambient air is mixed there with the throughflowing water and formed into a sparkling, soft water jet.

In the case of the jet regulators 1, 100 shown here, the outlet disk 8 is secured in the jet regulator housing in the direction opposite to the throughflow direction by at least one retaining device 24 or 107 respectively. In this case, the retaining device 24, 107 is held on, and preferably connected integrally to, a constituent or component, positioned upstream of the outlet disk 8 as viewed in the throughflow direction, of the jet regulator 1, 100.

In the case of the jet regulator 100 shown in FIGS. 9 to 14, the retaining device 107 is in the form of an annular wall which is held on and preferably integrally connected to the diffuser ring 105. In this case, the annular wall which serves as retaining device 107 has, in the annular wall subregion adjoining the annular gap 106 at the outflow side, at least one aeration opening 108 which serves for the induction of ambient air. The retaining device 107, formed as an annular wall, of the jet regulator 100 has in this case multiple aeration openings 108 which are spaced apart from one another in a circumferential direction. In the case of the jet regulator 100 shown in FIGS. 9 to 14, the outlet disk 8 is between the insertion stop 11, which is arranged on the housing inner circumference of the jet regulator housing, and the retaining device 107, which is configured as an annular wall. In order for the outlet disk 8 to be arranged between the insertion stop 11 and the retaining device 107 practically without play, the retaining device 107 which is configured as an annular wall acts on the outlet disk 8 at its inflow-side flat disk side.

The jet regulator housing 2 of the jet regulator 100 is also of two-part form and has an inflow-side housing part 12 and an outflow-side housing part 13 that can be detachably latched to said inflow-side housing part. Whereas, on the inflow-side housing part 12, the diffuser ring 105 is formed integrally with the retaining device 107, the outlet disk 8 can be inserted into the outflow-side housing part 13 as far as the insertion stop 11. It can be seen from the perspective individual part illustration in FIG. 14 that the diffuser 102 of the jet splitter 101 can be detachably latched, or similarly detachably connected, to an upstream or filter screen 23 arranged at the inflow side. The diffuser 102 can itself be inserted into the sleeve-shaped inflow-side housing part 12 which is connected integrally to the diffuser ring 105. The retaining device 107 which is configured as an annular wall and which is integrally connected to the diffuser ring 105 acts by way of its outflow-side face edge on the outlet disk 8. Said outlet disk 8 is in this case clamped between the insertion stop 11, which is provided in the jet regulator housing 2, and the outflow-side face edge of the retaining device 7. The outlet disk 8 is also held so as to be secured against rotation relative to the outflow-side housing part 12. For this purpose, multiple guide grooves 21 are provided on the inner circumference of the jet regulator housing 2 and in particular of the outflow-side housing part 12 thereof, which guide grooves interact in each case with a complementary guide projection 22 on the outer circumference of the outlet disk 8.

The jet regulators 1, 100 have, on the outer circumference at their inlet-side face edge region, a ring-shaped flange 35, as far as which the jet regulators 1, 100 can be inserted into a sleeve-shaped outlet mouthpiece (not shown here) which can be mounted on the water outlet of the outlet fitting.

The jet regulators 1, 100 are designed as aerated jet regulators, in which ambient air can be sucked into the housing interior via aeration openings 36 in the jet regulator housing 2, which ambient air is subsequently mixed there with the water flowing through to form a sparkling, soft water jet.

It is understood, therefore, that this invention is not limited to the particular embodiments disclosed, but is intended to cover all modifications which are within the spirit and scope of the invention as defined by the appended claims; the above description; and/or shown in the attached drawings.

The invention claimed is:

1. A jet regulator (1, 100) having a ring-shaped or sleeve-shaped jet regulator housing (2), the outlet face side (3) of which is formed as a perforated, grate and/or mesh structure with throughflow openings (6) bordered by flow-guiding walls, wherein the perforated, grate and/or mesh structure on the outlet face side is produced at least in regions of a non-deformable material and at least on the surface from a manually deformable dimensionally elastic plastic material (7), wherein the outlet face side (3) of the jet regulator housing (2) is in the form of an outlet disk (8) which is insertable into the jet regulator housing (2) and which bears the perforated, grate and/or mesh structure, the outlet disk (8) is secured in the jet regulator housing (2) in a direction opposite to the throughflow direction, which at least one retaining device (24; 107) is held on a component (15; 105), arranged upstream of the outlet disk (8) as viewed in the flow direction, of the jet regulator (1, 100).

2. The jet regulator as claimed in claim 1, wherein the outlet disk (8) is formed as a multi-component injection-molded part which has a main or molded body (9) composed of hard or dimensionally rigid plastic material onto which is injection-molded a constituent composed of comparatively soft or dimensionally elastic plastic material (7).

3. The jet regulator as claimed in claim 1, wherein the outlet disk (8) is insertable into the jet regulator housing (2) from the inlet-face-side ring or sleeve opening of the jet regulator housing (2) as far as at least one insertion stop (11).

4. The jet regulator as claimed in claim 1, wherein a jet splitter (14; 101) is positioned upstream of the outlet disk (8) as viewed in the flow direction.

5. The jet regulator as claimed in claim 4, wherein at least one insert part (15, 16, 30, 39) is insertable into the jet regulator housing (2) and which has a perforated, grate and/or mesh structure with throughflow openings (19, 48, 43) bordered by flow-guiding walls is positioned upstream of the outlet disk (8), and/or downstream of the jet splitter (14), as viewed in the flow direction.

6. The jet regulator as claimed in claim 4, wherein the outlet disk (8), the at least one insert part (15, 16) and/or the jet splitter (14; 101) are held in a rotationally secured manner in the jet regulator housing (2).

7. The jet regulator as claimed in claim 4, wherein, on the inner circumference of the jet regulator housing (2), there is provided at least one guide groove (21) and/or at least one guide projection which interacts with a complementary guide projection (22) and/or with a complementary guide groove on the outlet disk (8), on the at least one insert part (15, 16) and/or on the jet splitter (14; 101).

8. The jet regulator as claimed in claim 1, wherein an upstream or filter screen (23) is detachably locked, or detachably held, on the jet regulator housing (2) at the inlet side.

9. The jet regulator as claimed in claim 1, wherein the component (15; 105) of the jet regulator (1, 100) which bears the at least one retaining device (24; 107) is detachably locked, or connected, to the jet regulator housing (2) which accommodates the outlet disk (8) within it.

10. The jet regulator as claimed in claim 1, wherein the at least one retaining device (24; 107) is integrally connected to the component that bears it.

11. The jet regulator as claimed in claim 4, wherein the jet splitter (101) has a pot-shaped diffuser (102), the pot base (103) of which is in the form of an impingement surface which diverts the inflowing water outward and which has throughflow openings (104) in the circumferential wall of its pot shape.

12. The jet regulator as claimed in claim 11, wherein the diffuser (102), at least in that subregion of its circumferential wall which has the throughflow openings (104), is engaged around by a diffuser ring (105), the diffuser ring (105) borders, between itself and the diffuser (102), an annular gap (106) which narrows in the throughflow direction at least in sections and which is open to the outflow side of the jet regulator (100).

13. The jet regulator as claimed in claim 4, wherein the at least one retaining device (107) is formed integrally on a diffuser ring (105) the jet splitter (101) which has a diffuser (102).

14. The jet regulator as claimed in claim 12, wherein the at least one retaining device (107) is configured as an annular wall which is held on the diffuser ring (105).

15. The jet regulator as claimed in claim 14, wherein the annular wall which serves as retaining device (107) has, in an annular wall subregion adjoining the annular gap (106) at the outflow side, a plurality of aeration openings (108) for the induction of ambient air, spaced apart from one another in a circumferential direction.

16. The jet regulator as claimed in claim 1, wherein the outlet disk (8) is arranged between an insertion stop (11) arranged on the housing inner circumference of the jet regulator housing (2) and the at least one retaining device (24, 107).

17. The jet regulator as claimed in claim 1, wherein the at least one retaining device (24; 107) acts on the outlet disk (8) at an inflow, flat disk side.

18. The jet regulator as claimed in claim 1, wherein the jet regulator housing (2) is a two-part housing and has an inflow-side housing part (13) and an outflow-side housing part (12) that can be detachably latched to said inflow-side housing part.

19. The jet regulator as claimed in claim 18, wherein, on the inflow-side housing part (13), the diffuser ring (105) is formed integrally with the at least one retaining device (107), and/or the outlet disk (8) is insertable into the outflow-side housing part (12) as far as the insertion stop (11).

20. The jet regulator as claimed in claim 4, wherein at least one component of the following components: outlet disk (8), insert part (15, 16), jet splitter (14) or upstream screen (23), is supported by means of the at least one retaining device (24), formed in particular as a central pin, on a component (8, 15) which is arranged at the inflow side and/or at the outflow side.

21. The jet regulator as claimed in claim 1, wherein the outlet disk (8), in its partial region which bears against the jet regulator housing (2), bears the constituent composed of comparatively soft or dimensionally elastic plastic material in order to seal off the ring-shaped zone between the outlet disk (8) and housing inner circumference.

* * * * *